United States Patent [19]

Yoshida et al.

[11] Patent Number: 4,627,553

[45] Date of Patent: Dec. 9, 1986

[54] FUEL SUPPLYING APPARATUS HAVING QUANTITY AND PRICE PRESET SWITCHES

[75] Inventors: Takeomi Yoshida, Kanagawa; Kazuhisa Yamashita, Kawasaki; Yukio Miura, Fujisawa, all of Japan

[73] Assignee: Tokico Ltd., Kawasaki, Japan

[21] Appl. No.: 692,913

[22] Filed: Jan. 18, 1985

[30] Foreign Application Priority Data

Jan. 20, 1984 [JP] Japan ..... 59-5857[U]

[51] Int. Cl.[4] ..... B67D 5/30

[52] U.S. Cl. ..... 222/14; 222/25; 222/74; 141/98; 364/465; 340/815.03

[58] Field of Search ..... 222/14, 16, 17, 18, 222/19, 20, 22, 25, 27, 52, 74, 75, 63; 141/98; 364/465, 510; 340/815.02, 815.03, 706, 711, 752, 802

[56] References Cited

U.S. PATENT DOCUMENTS

| | | | |
|---|---|---|---|
| 3,598,283 | 8/1971 | Krutz et al. | 222/14 |
| 3,603,480 | 9/1971 | Irie et al. | 222/20 |
| 3,692,212 | 9/1972 | Irie et al. | 222/52 X |
| 3,773,219 | 11/1973 | Irie et al. | 222/14 X |
| 4,216,529 | 8/1980 | Krystek et al. | 364/465 X |
| 4,247,899 | 1/1981 | Schiller et al. | 222/26 X |
| 4,550,859 | 11/1985 | Dow, Jr. et al. | 222/14 X |

*Primary Examiner*—H. Grant Skaggs

*Assistant Examiner*—Edward S. Ammeen

*Attorney, Agent, or Firm*—Roberts, Spiecens & Cohen

[57] ABSTRACT

A fuel supplying apparatus comprises a fuel supplying hose having a fuel supplying nozzle provided on a tip end thereof, a preset switch comprising a fuel supplying quantity preset switch and a fuel supplying price preset switch provided on the fuel supplying hose at a position in a vicinity of the fuel supplying nozzle, where the fuel supplying quantity preset switch is for selectively and sequentially presetting the predetermined quantity of fuel for preset quantity fuel supplying operation in response to the number of manipulation times of the switch and the fuel supplying price preset switch is for selectively and sequentially presetting the predetermined price of fuel for preset price fuel supplying operation in response to the number of manipulation times of the switch, an indicator unit for indicating either one of the preset quantity and the preset price preset by the preset switch, and a control circuit for presetting either one of the preset quantity or the preset price selected from the predetermined plural number of preset quantities and the predetermined plural number of preset prices, in response to the selective manipulation of either one of the fuel supplying quantity preset switch and the fuel supplying price preset switch as well as to the number of manipulation times of the selected switch. The indicator unit indicates the preset fuel quantity or the preset fuel price preset in the control device.

5 Claims, 13 Drawing Figures

| M(I) | PRESET FUEL QUANT |
|---|---|
| M(0) | FULL |
| M(1) | 10.00 |
| M(2) | 20.00 |
| M(3) | 30.00 |
| M(4) | 40.00 |
| M(5) | 50.00 |

| N(I) | PRESET FUEL PRICE |
|---|---|
| N(0) | FULL |
| N(1) | 1000 |
| N(2) | 2000 |
| N(3) | 3000 |
| N(4) | 4000 |
| N(5) | 5000 |

FUEL SUPPLYING APPARATUS HAVING QUANTITY AND PRICE PRESET SWITCHES

BACKGROUND OF THE INVENTION

The present invention generally relates to fuel supplying apparatuses, and more particularly to a fuel supplying apparatus which has a fuel supplying quantity preset switch and a fuel supplying price preset switch in a vicinity of a fuel supplying nozzle which is provided at one end of a fuel supplying hose, and a preset quantity fuel supplying operation or a preset price fuel supplying operation is selectively carried out by manipulating these switches and presetting the quantity or price of fuel to be supplied.

Generally, as kinds of preset fuel supplying operations of a fuel supplying apparatus, there are a preset quantity fuel supplying operation in which the fuel supplying operation is stopped when the quantity of supplied fuel reaches a preset quantity and a preset price fuel supplying operation in which the fuel supplying operation is stopped when the price of supplied fuel reaches a preset price. Conventionally, the fuel supplying apparatus which carries out such operations required many switches such as a preset quantity fuel supplying mode selection switch, a fuel supplying quantity preset switch, a preset price fuel supplying mode selection switch, a fuel supplying price preset switch and the like.

On the other hand, there is the so-called hanging type fuel supplying apparatus in which a fuel supplying hose having the fuel supplying nozzle provided on the tip end thereof, is provided in a hanging manner from a delivery unit which is located at a high position such as a ceiling of a fuel supplying station. In such a hanging type fuel supplying apparatus, switches are provided in a vicinity of the fuel supplying nozzle, so that the operator may easily manipulate these switches. In order to carry out the kinds of preset fuel supplying operations in a conventional hanging type fuel supplying apparatus, it is necessary to provide the many switches mentioned above in the vicinity of the fuel supplying nozzle in addition to providing an elevator switch for raising or lowering the fuel supplying nozzle. According to this configuration, however, the construction of a switch box which accommodates the switches which are provided in the vicinity of the fuel supplying nozzle, is complex. Further, a flowing path for the fuel within the fuel supplying hose is narrow, because a large number of signal lines originate from the switches. Moreover, it is uneasy to manipulate the fuel supplying nozzle since the switch box is bulky. When the switch box is to be downsized, the switches must be arranged close to each other, but this will increase the possibility of erroneous manipulation of the switches, such as an erroneous manipulation of a switch adjacent to a switch which is actually to be manipulated. The possibility of such an erroneous manipulation of the switches increases as the number of switches increases.

Therefore, the conventional hanging type fuel supplying apparatus is only provided with one fuel supplying preset switch for carrying out either the present quantity fuel supplying operation or the preset price fuel supplying operation. Hence, only one of the present quantity fuel supplying operation and the preset price fuel supplying operation can be carried out by the conventional hanging type fuel supplying apparatus.

SUMMARY OF THE INVENTION

Accordingly, it is a general object of the present invention to provide a novel and useful fuel supplying apparatus in which the problems described heretofore are eliminated.

Another and more specific object of the present invention is to provide a fuel supplying apparatus in which a desired fuel supplying quantity or a desired fuel supplying price can be preset to selectively carry out a preset quantity fuel supplying operation or a preset price fuel supplying operation by the provision of only two switches, one being a preset quantity fuel supplying switch for presetting the desired fuel supplying quantity and the other being a preset price fuel supplying switch for presetting the desired fuel supplying price. The fuel supplying apparatus of the present invention can selectively carry out the preset quantity fuel supplying operation and the preset price fuel supplying operation by using reduced number of switches so that the apparatus is especially effective when applied to a hanging type fuel supplying apparatus where the maneuverability, space factor and the like are important.

Still another object of the present invention is to provide a fuel supplying apparatus which is further provided with a display apparatus having a simple construction for displaying the preset fuel supplying quantity and the preset fuel supplying price within a small space.

Other objects and further features of the present invention will be apparent from the following detailed description when read in conjunction with the accompanying drawings.

DETAILED DESCRIPTION

Figure 1:
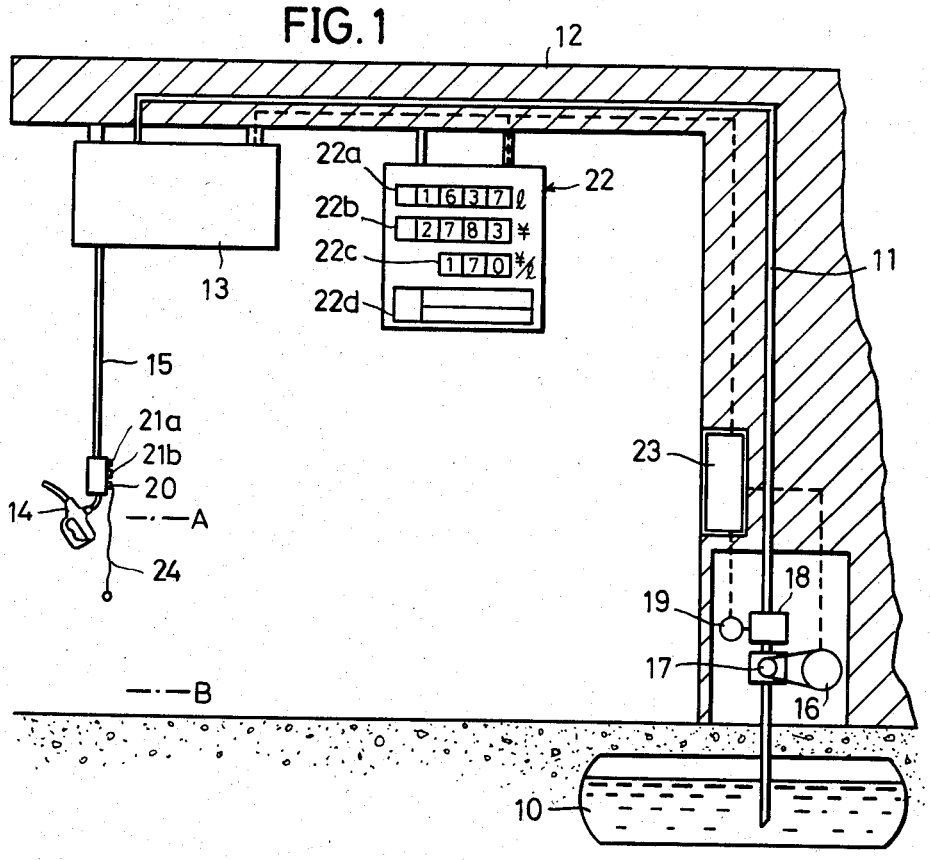
FIG. 1 is a partial cross sectional view showing the construction of an embodiment of a fuel supplying apparatus according to the present invention.

FIG. 1 shows an embodiment of the present invention applied to a hanging type fuel supplying apparatus. In FIG. 1, one end of a pipe arrangement 11 communicates to an underground tank 10 which stores the fuel. The other end of the pipe arrangement 11 communicates to a fuel supplying hose 15 which has a fuel supplying nozzle 14 provided at a tip end thereof, through a delivery unit 13 which is provided on a structure 12 located at a high part of the fuel supplying station. A pump 17 which is driven by a pump motor 16, and a flowmeter 18 for measuring the fuel supplying quantity, are provided in the pipe arrangement 11. The flowmeter 18 comprises a flow quantity pulse generator 19 which generates a flow quantity pulse signal proportional to the flow quantity of the fuel which is measured.

An elevator switch 20, a fuel supplying quantity preset switch 21*a* and a fuel supplying price preset switch 21*b* are located on the fuel supplying hose 15, in a vicinity of the fuel supplying nozzle 14. The elevator switch 20 drives a hose elevator driving mechanism (not shown) within the delivery unit 13, and raises and lowers the fuel supplying nozzle 14 between a waiting position A where the fuel supplying nozzle 14 does not interfere with a vehicle (not shown) which enters and leaves the fuel supplying station, and a fuel supplying position B which is suited for carrying out the fuel supplying operation with respect to the vehicle. The fuel supplying quantity preset switch 21*a* and the fuel supplying price preset switch 21*b* respectively preset the fuel supplying quantity and the price of fuel to be supplied. As in the conventional fuel supplying apparatus, the elevator switch 20 comprises a push button switch which is pushed when raising the fuel supplying hose 15 and the fuel supplying nozzle 14, and a pull string 24 which is pulled when lowering the fuel supplying hose 15 and the fuel supplying nozzle 14.

An indicator unit 22 is located within the fuel supplying station, at a position where it is easily visible by the operator. The indicator unit 22 comprises an indicator 22*a* for displaying the quantity of the supplied fuel, an indicator 22*b* for displaying the price of the supplied fuel, an indicator 22*c* for displaying the unit price of the fuel, and an indicator 22*d* for displaying the respective preset value for the preset quantity fuel supplying mode and the preset price fuel supplying mode.

Figure 3A:
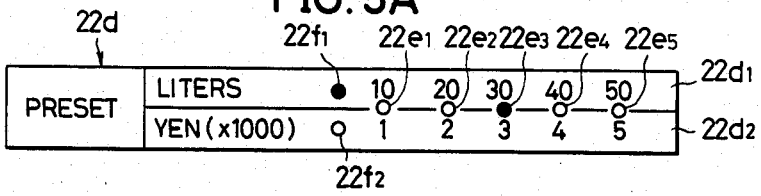
FIGS. 3A and 3B respectively are diagrams for explaining the displaying states of an indicator unit in the fuel supplying apparatus shown in FIG. 1.
Figure 3B:
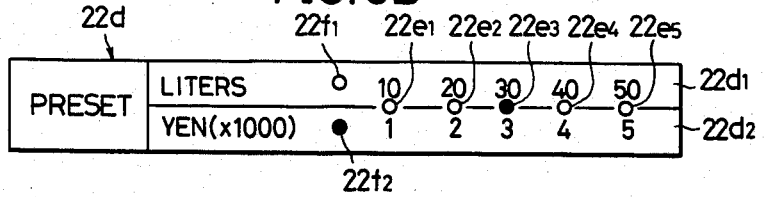

As shown in FIGS. 3A and 3B, the indicator 22*d* has a series of numerals which represent preset values of 10 l, 20 l, 30 l, 40 l, and 50 l for the preset quantity fuel supplying operation, which numerals are aligned horizontally in an upper half $22d_1$ of the indicator 22*d*. In a lower half $22d_2$ of the indicator 22*d*, there are provided horizontally a series of numerals which represent the preset prices of 1000 YENS, 2000 YENS, 3000 YENS, 4000 YENS, and 5000 YENS for the preset price fuel supplying operation, at corresponding positions to the numerals in the upper half $22d_1$ so that a numeral in the upper half $22d_1$ and a corresponding numeral in the lower half $22d_2$ make up a pair. Between the numerals of the upper half $22d_1$ and the numerals of the lower half $22d_2$, there are provided five indication lamps $22e_1$ through $22e_5$. The indication lamps are selectively turned ON to simultaneously indicate the pair of numerals in the upper and lower halves $22d_1$ and $22d_2$, and constitute first indicator means. For example, when the third lamp $22e_3$ from the left is turned ON as shown in FIGS. 3A and 3B, the preset values of 30 l and 3000 YENS are indicated simultaneously. At the left of the numerals in the upper and lower halves $22d_1$ and $22d_2$, there are provided indication lamps $22f_1$ and $22f_2$, respectively. These lamps $22f_1$ and $22f_2$ constitute second indicator means which, when selectively turned ON, indicate which of the upper and lower numerals are selected. The preset value for the preset quantity fuel supplying operation is indicated when the upper lamp $22f_1$ is turned ON as shown in FIG. 3A, and the preset value for the preset price fuel supplying operation is indicated when the lower lamp $22f_2$ is turned ON as shown in FIG. 3B. Hence, when the lamps $22e_3$ and $22f_1$ are simultaneously turned ON as shown in FIG. 3A, it is indicated that the preset fuel supplying quantity of 30 l is selected for the preset quantity fuel supplying operation. Similarly, when the lamps $22e_3$ and $22f_2$ are simultaneously turned ON as shown in FIG. 3B, it is indicated that the preset price of 3000 YENS is selected for the preset price fuel supplying mode.

A control device 23 is located at a non-dangerous part within the fuel supplying station.

Figure 2:
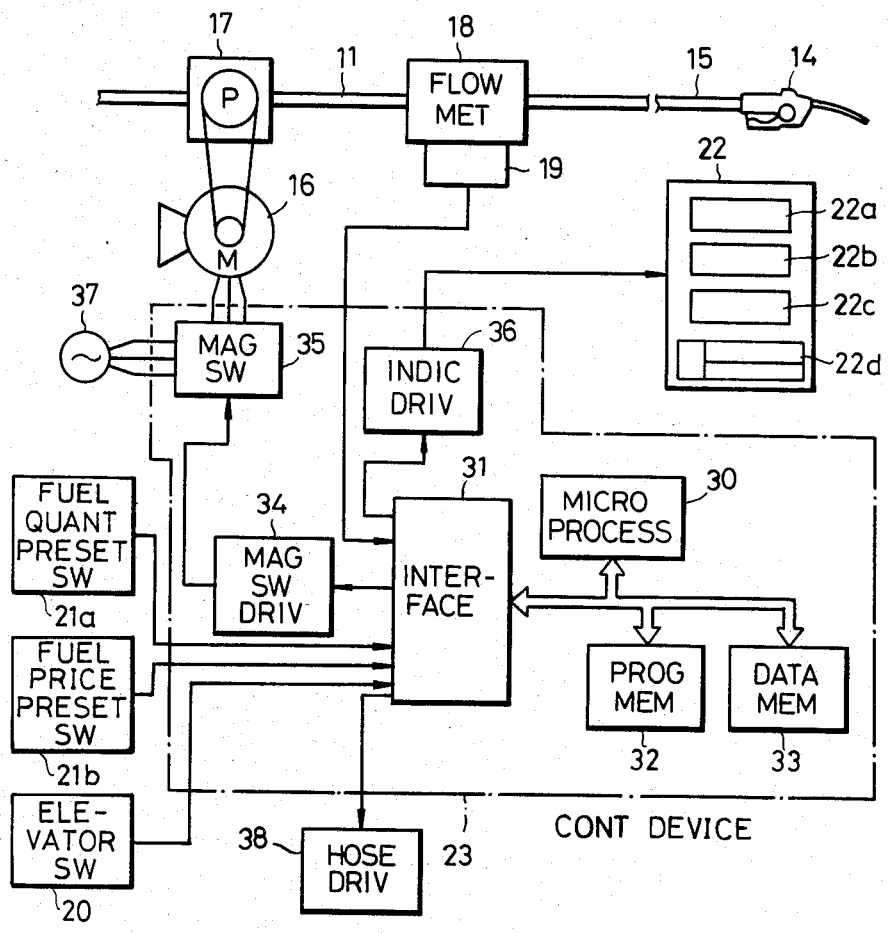
FIG. 2 is a systematic block diagram showing a control system of the fuel supplying apparatus shown in FIG. 1.

Next, a description will be given with respect to the system constitution of the fuel supplying apparatus shown in FIG. 1, by referring to FIG. 2. In FIG. 2, those parts which are the same as those corresponding parts in FIG. 1 are designated by the same reference numerals, and their description will be omitted.

The control device 23 comprises a microprocessor 30, an interface 31, a program memory 32, a data memory 33, a magnetic switch driving circuit 34, a magnetic switch 35, and an indicator driving circuit 36. A hose elevator driving mechanism 38 is located within the delivery unit 13.

According to the control contents which are pre-stored in the program memory 32, the microprocessor 30 reads in an operation signal from the elevator switch 20 through an interface 31, and drives and controls the hose elevator driving mechanism 38 to raise and lower the fuel supplying nozzle 14. In addition, responsive to the manipulation of the elevator switch 20 and the drive and stoppage of the hose elevator driving mechanism 38, the microprocessor 30 carries out operations such as driving and stopping of the motor 16 and resetting of the indicators 22*a* and 22*b* of the indicator unit 22 to zero. Moreover, the microprocessor 30 counts the flow quantity pulses of the flow quantity pulse signal which is received from the flow quantity pulse generator 19 though the interface 31, and calculates the quantity Q of supplied fuel and the price of supplied fuel. The calculated values are supplied to the indicator driving circuit 36 through the interface 31 so as to display the calculated values on the indicators 22*a* and 22*b*.

Further, according to the control contents which are pre-stored in the program memory 32, the microprocessor 30 operates the fuel supplying apparatus in three modes, that is, a normal fuel supplying mode, a preset fuel supplying mode, and an integral quantity fuel supplying mode.

The operation of the microprocessor 30 for the three modes will now be described in conjunction with the flow charts shown in FIGS. 4 through 9.

Figure 4:
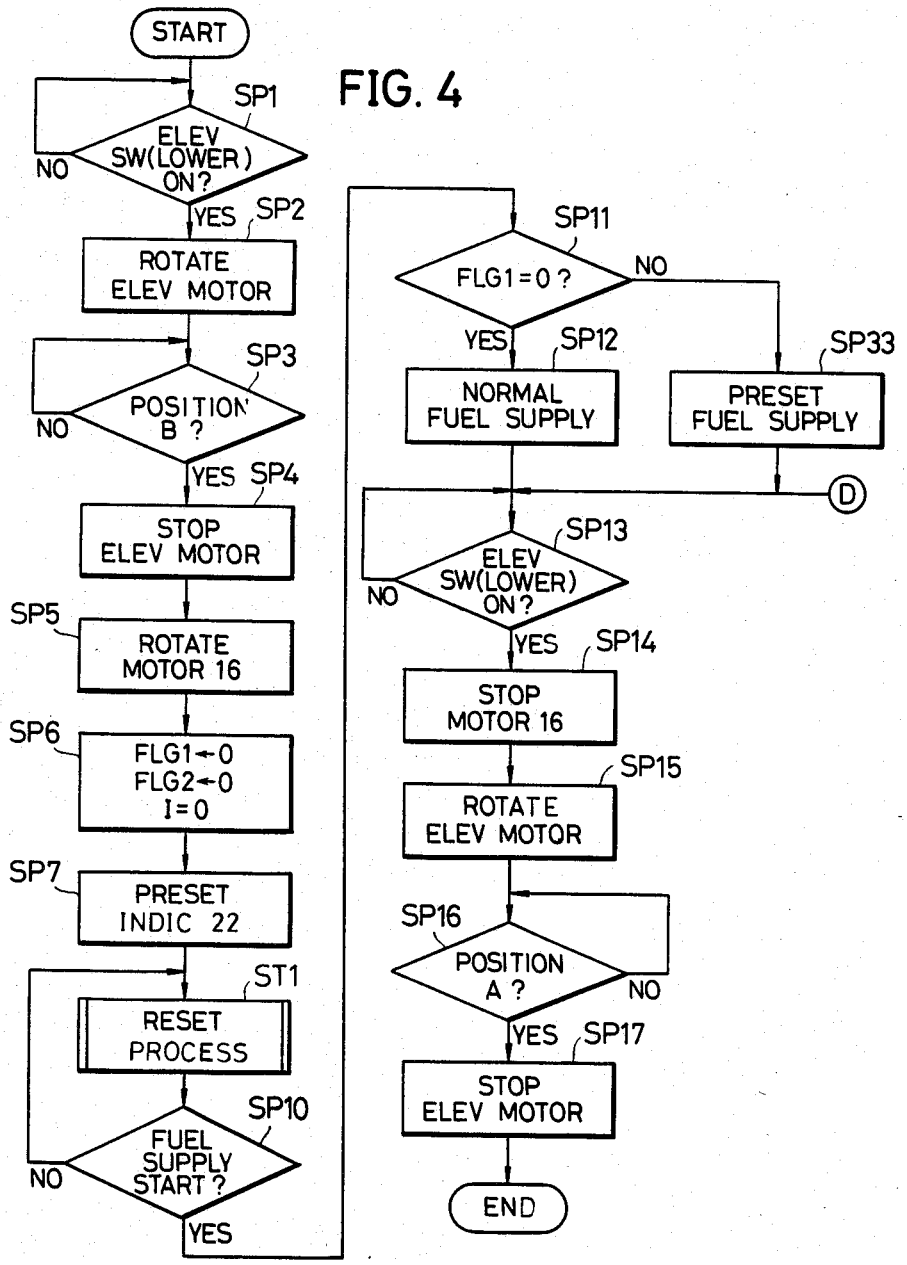
FIGS. 4, 5, 6, 7, 8 and 9 respectively are flow charts for explaining the operation of the control system shown in FIG. 2.

(1) Normal fuel supplying mode:

When the fuel supplying apparatus is in a state where the fuel supplying nozzle 14 is in the waiting position A and the elevator switch 20 is manipulated so as to lower the fuel supplying nozzle 14, this manipulation of the elevator switch 20 is detected in a step SP1 shown in FIG. 4, and an elevator motor (not shown) within the delivery unit 13 is rotated in a direction so as to lower the fuel supplying nozzle 14 in a step SP2. A step SP3 detects that the fuel supplying nozzle 14 has reached the fuel supplying position B, and a step SP4 stops the rotation of the elevator motor.

Next, a pump driving motor 16 starts to rotate in a step SP5. In a step SP6, flags FLG1 and FLG2 are reset to zero and a preset quantity I is initialized (I=0). In a step SP7, the indicator unit 22 is reset.

Figure 5:
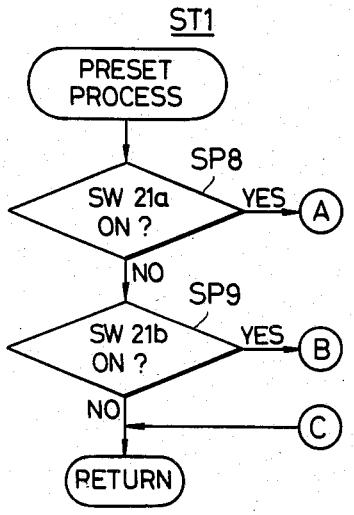

When steps SP8 and SP9 in a stage ST1 shown in FIG. 5 discriminate that the fuel supplying quantity preset switch 21*a* and the fuel supplying price preset switch 21*b* are not manipulated and a step SP10 shown in FIG. 4 detects the start of a fuel supplying operation, the operation advances to a step SP11. The step SP10 detects the start of the fuel supplying operation by detecting the existence of the flow quantity pulse signal from the flow quantity pulse generator 19. The step SP11 discriminates whether the flag FLG1 is zero, and a normal fuel supplying operation is carried out in a step SP12 when the discrimination result in the step SP11 is YES.

When the elevator switch 20 is manipulated to raise the fuel supplying nozzle 14 after the normal fuel supplying operation is finished in the step SP12, a step SP13 detects this manipulation of the elevator switch 20. The rotation of the pump motor is stopped in a step SP14, and the elevator motor is rotated in the direction to raise the fuel supplying hose 15 in a step SP15. When a step SP16 detects that the fuel supplying nozzle 14 has reached the waiting position A, the elevator motor is stopped in a step SP17.

(2) Preset fuel supplying mode:

There are two kinds of preset fuel supplying modes, namely, the preset quantity fuel supplying mode in which the fuel supplying quantity preset switch **21*a* is manipulated and the preset price fuel supplying mode in which the fuel supplying price preset switch 21*b*** is manipulated. The individual fuel supplying mode and the relationship between the two fuel supplying modes will now be described.

Figure 6:
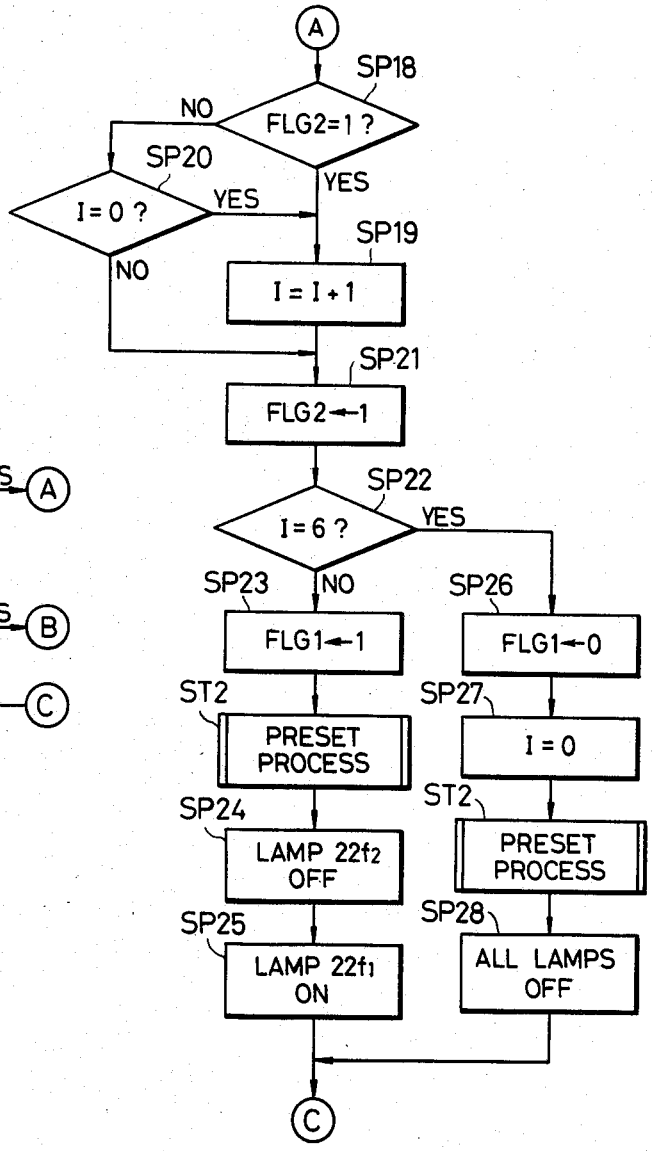

(2a) Preset quantity fuel supplying mode:

When the fuel supplying quantity preset switch **21*a* is manipulated, the discrimination result in the step SP8 in a stage ST1 shown in FIG. 5 becomes YES, and the operation advances to the flow chart shown in FIG. 6 through a connecting point Ⓐ. First, the value I of a preset register is updated in steps SP18 to SP20. A preset quantity which corresponds to the value I of the preset register is designated by M(I), and the preset fuel supplying quantity corresponding to the preset quantity M(I) is shown in the table in FIG. 11A. In the table shown in FIG. 11A, M(O) represents a case where the preset fuel supplying operation is not carried out, that is, a case where the normal fuel supplying operation described before is carried out. In this case, the fuel supplying operation stops automatically when the tank of the vehicle becomes full. The fuel supplying quantity corresponding to the preset value M(I) is stored in the data memory 33** in advance.

The value I of the preset value M(I) is successively counted up in a step SP19 depending on the number of times the fuel supplying quantity preset switch **21*a* is manipulated. It is assumed that the fuel supplying apparatus is in the preset quantity fuel supplying mode when the flag FLG2 is "1", and the operation advances from the step SP18 to the step SP19 to count up the value I when the previous flag FLG2 is "1". When the previous flag FLG2 is "0", the discrimination result in the step SP18 is NO, and the value of I is discriminated in a step SP20. When the value of I is "0", the operation advances to the step SP19. When the value of I is not "0", the operation advances directly to a step SP21**. In the latter case, therefore, the value of I is not counted up.

In the step SP21, the flag FLG2 is set to "1". Since the value I assumes a value between "0" and "5", a step SP22 discriminates whether the value I is equal to "6". The discrimination result in the step SP22 is NO until the I reaches "6", and the flag FLG1 is set to "1" in a step SP23 when the discrimination result in the step SP22 is NO. The preset process for M(I) is then carried out in a stage ST2, and the operation then advances to steps SP24 and SP25. On the other hand, when the value I reaches "6", the discrimination result in the step SP22 becomes YES, and the flag FLG1 is set to "0" in a step SP26. The value I is set to "0" in a step SP27 which follows. Then, the preset process for M(O) is carried out in a stage ST2 and the operation advances to a step SP28.

Figure 8:
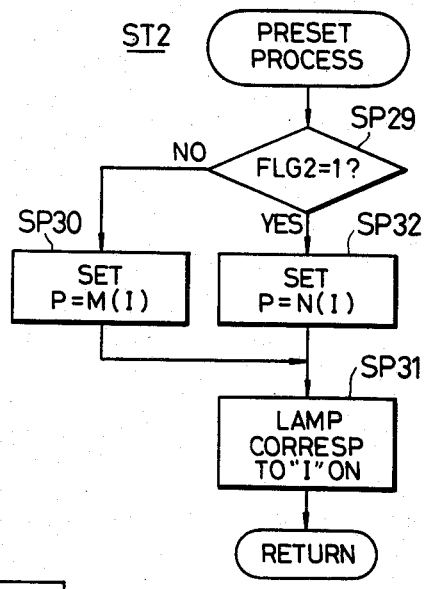

As shown in FIG. 8, the stage ST2 discriminates whether the flag FLG2 is "1". When the discrimination result is NO, the operation advances to a step SP30 wherein a fuel supplying quantity P which corresponds to M(I) is set. In a step SP31 which follows, one of the indication lamps **22*e*$_1$ through 22*e*$_5$ which corresponds to the value I is turned ON. These indication lamps 22*e*$_1$ through 22*e*$_5$ are turned ON in correspondence with the values "1", "2", "3", "4", and "5" of I respectively from the left in FIGS. 3A and 3B. A step SP32** presets the fuel supplying quantity P=N(I) for the case of the preset price fuel supplying operation which will be described later.

In the above mentioned step SP24 the preset price fuel supplying mode indication lamp **22*f*$_2$ is turned OFF, and in a following step SP25 the preset quantity fuel supplying mode indication lamp 22*f*$_1$ is turned ON. Further, all the indication lamps 22*e*$_1$ through 22*e*$_2$, 22*f*$_1$ and 22*f*$_2$ are turned OFF in the step SP28. Therefore, in the former case in which the operation advances to the steps SP24 and SP25 the preset quantity fuel supplying mode is indicated by the indication lamps, while in the latter case in which the operation advances to the step SP28** the normal fuel supplying mode is indicated.

After the fuel supplying quantity is set and displayed in this way for the preset quantity fuel supplying mode, the discrimination result in the step SP11 is NO and the operation advances to a step SP33 to carry out the preset fuel supplying operation.

Figure 7:
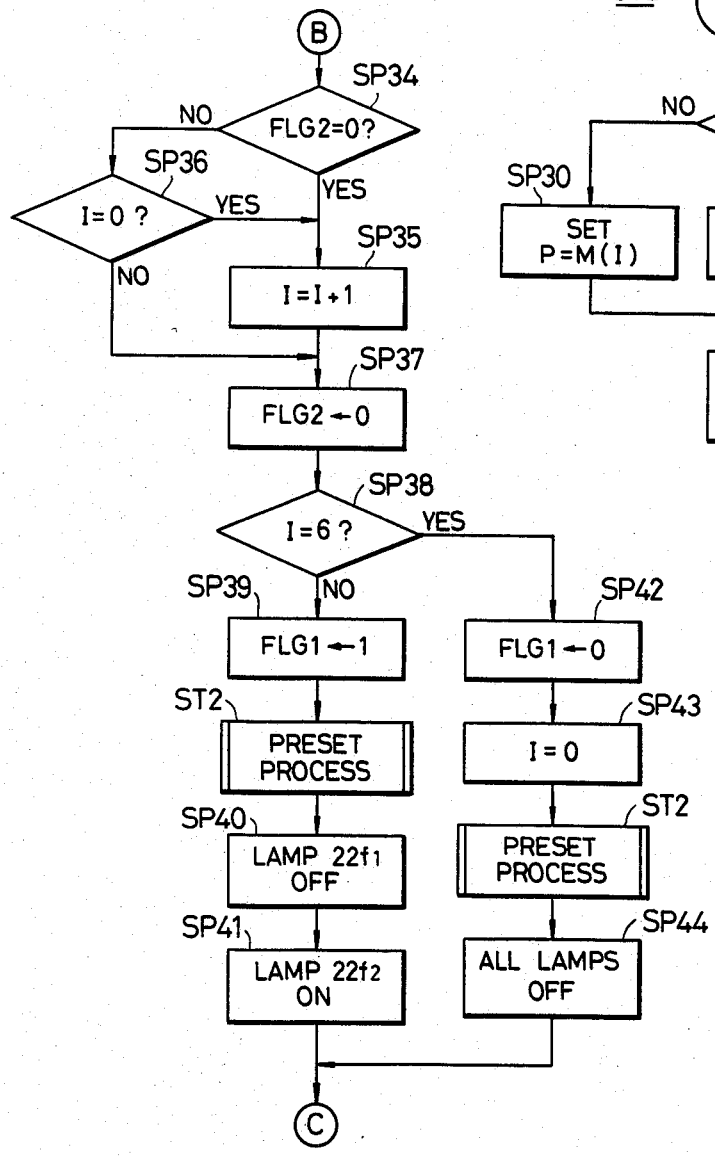

(2b) Preset price fuel supplying mode:

By the manipulation of the fuel supplying price preset switch **21*b*, the discrimination result of the step SP9 within the stage ST1 (FIG. 5) becomes YES and the operation advances to the flow chart shown in FIG. 7 through a connecting point Ⓑ. First, the value I of the preset register is updated in steps SP34 through SP36. The preset quantity which corresponds to the value I of the preset register is designated by N(I), and the preset fuel supplying price corresponding to the preset quantity N(I) is shown in the table in FIG. 11B. In the table shown in FIG. 11B, N(O) represents a case where the preset fuel supplying operation is not carried out, that is, a case where the normal fuel supplying operation described before is carried out. In this case, the fuel supplying operation stops automatically when the tank of the vehicle becomes full. The fuel supplying quantity corresponding to the preset value N(I) is stored in the data memory 33** in advance.

The value I of the preset value N(I) is successively counted up in a step SP35 depending on the number of times the fuel supplying price preset switch **21*b* is manipulated. It is assumed that the fuel supplying apparatus is in the preset fuel supplying mode when the previous flag FLG2 is "0". When the previous flag FLG2 is "0", the discrimination result in the step SP34 which discriminates whether the flag FLG2 is "0" is YES, and the operation advances from the step SP34 to the step SP35 so as to successively count up the value I. When the previous flag FLG2 is "1", the discrimination result in the step SP34 is NO, and the value I is discriminated in the step SP36. When the value I is "0", the operation advances to the step SP35**. On the other hand, when the value I is other than "0" the operation advances directly to a step SP37. In the latter case, therefore, the value I is not counted up.

In the step SP37, the flag FLG2 is set to "0". Since the value I assumes a value between "0" and "5", a step SP38 discriminates whether the value I is equal to "6". The discrimination result in the step SP38 is NO until the value I reaches "6", and the flag FLG1 is set to "1" in a step SP39 when the discrimination result in the step SP38 is NO. The preset process for N(I) is carried out in the stage ST2, and the operation advances to steps SP40 and SP41. On the other hand, when the value I reaches "6", the dicrimination result in the step SP38 becomes YES and the flag FLG1 is set to "0" in a step SP42. The value I is set to "0" in a step SP43 and the preset process for N(O) is carried out in the stage ST2. The operation then advances to a step SP44.

The stage ST2 (FIG. 8) discriminates whether the flag FLG2 is "1". When the discrimination result is YES the operation advances to the step SP32 wherein the fuel supplying quantity P corresponding to N(I) is set. The fuel supplying quantity P is a conversion quantity of the preset fuel supplying price which corresponds to N(I). In the step SP31 which follows, one of the indication lamps $22e_1$ through $22e_5$ which corresponds to the value I is turned ON in a manner similar to that of the previously described preset quantity fuel supplying mode.

In the step SP40 shown in FIG. 7 the preset quantity fuel supplying mode indication lamp $22f_1$ is turned OFF, and the preset price fuel supplying mode indication lamp $22f_2$ is turned ON in the step SP41. Further, all of the indication lamps $22e_1$ through $22e_5$, $22f_1$ and $22f_2$ are turned OFF in the aforementioned step SP44. Therefore, in the former case the preset price fuel supplying mode is indicated by the indication lamps, while in the latter case the normal fuel supplying mode is indicated by the indicator unit 22.

After the fuel supplying quantity is set and displayed in this way for the preset price fuel supplying mode, the operation advances from the step SP11 to the step SP33 wherein the preset fuel supplying operation is carried out.

(2) Relationship between the preset quantity fuel supplying mode and the preset price fuel supplying mode:

In the fuel supplying apparatus of the present invention it is possible to change the fuel supplying mode from the preset quantity fuel supplying mode to the preset price fuel supplying mode and vice versa.

The discrimination of these two kinds of fuel supplying modes are carried out on the basis of the flag FLG2 which assumes the value "1" for the preset quantity fuel supplying mode and the value "0" for the preset price fuel supplying mode. In the steps SP18 through SP20 in FIG. 6 as well as in the steps SP34 through SP36 in FIG. 7 the operation is carried out depending on the existence of a change in the value of the flag FLG2. When there is no change in the value of the flag FLG2 the value I is counted up. But when there is a change in the value of the flag FLG2, the value I is not counted up. The fuel supplying mode is changed in the latter state. For example, when the fuel supplying price preset switch 21*b* is manipulated once during the preset quantity fuel supplying mode in which the preset fuel supplying quantity is selected to 30 l, the fuel supplying mode is immediately changed to the preset price fuel supplying mode in which the preset fuel supplying price is selected to 3000 YENS.

Figures 9, 11A, 11B:
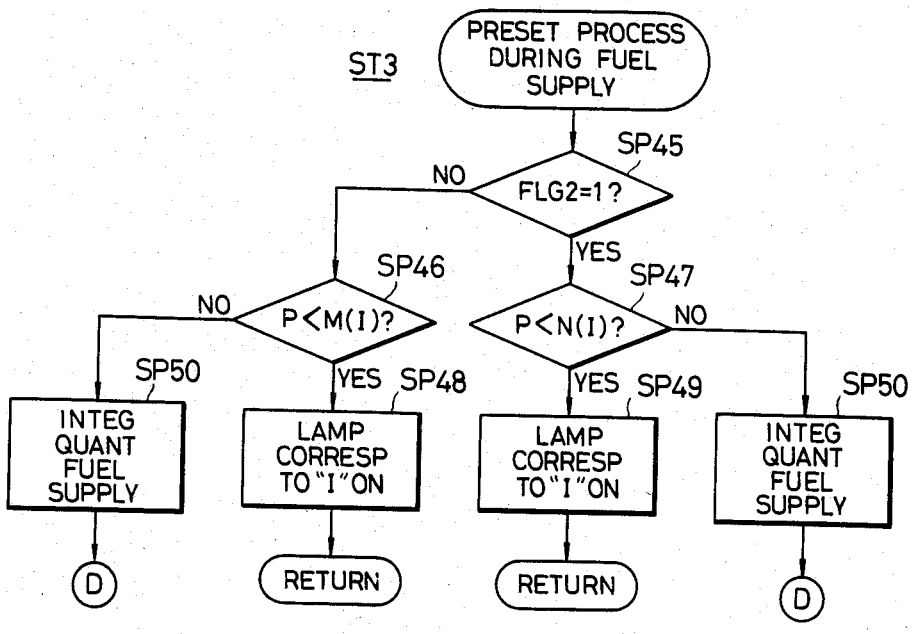
FIGS. 11A and 11B are tables for explaining the preset fuel quantity and preset fuel price, respectively.

When such change in the fuel supplying mode takes place, a stage ST3 shown in FIG. 9 carries out the preset process of the preset quantity during the fuel supplying operation.

In other words, when the fuel supplying mode is changed from the preset quantity fuel supplying mode to the preset price fuel supplying mode, the discrimination result in the step SP45 which discriminates whether the flag FLG2 is "1" is NO and the operation advances to the step SP46. On the other hand, when the fuel supplying mode is changed adversely from the fuel supplying price presetting mode to the preset quantity fuel supplying mode, the discrimination result in the step SP45 is YES and the operation advances to the step SP47. In the steps SP46 and SP47 the fuel supplying quantity P for the on-going fuel supplying operation and the newly changed preset value M(I) or N(I) are compared. When the fuel supplying quantity P is smaller than M(I) or N(I) the discrimination result in the step SP46 or SP47 is YES and one of the indication lamps $22e_1$ through $22e_5$ which corresponds to the preset value M(I) or N(I) is turned ON. On the other hand, when the preset value M(I) or N(I) is smaller than the fuel supplying quantity P, the discrimination result in the step SP46 or SP47 is NO. In this case, the integral quantity fuel supplying operation is carried out in a step SP50 which will be described later. The operation thereafter advances to the step SP13 shown in the FIG. 4 through a connection point Ⓓ.

(3) Integral quantity fuel supplying mode:

This mode of operation corresponds to the fuel supplying operation carried out in the above mentioned step SP50. This operation is started when the fuel supplying quantity P is greater than the newly changed preset value M(I) or N(I). In this mode, the fuel supplying operation is automatically stopped when the quantity of supplied fuel reaches an integral value which is larger than and closest to the the quantity of fuel supplied up to that moment.

Figure 10:
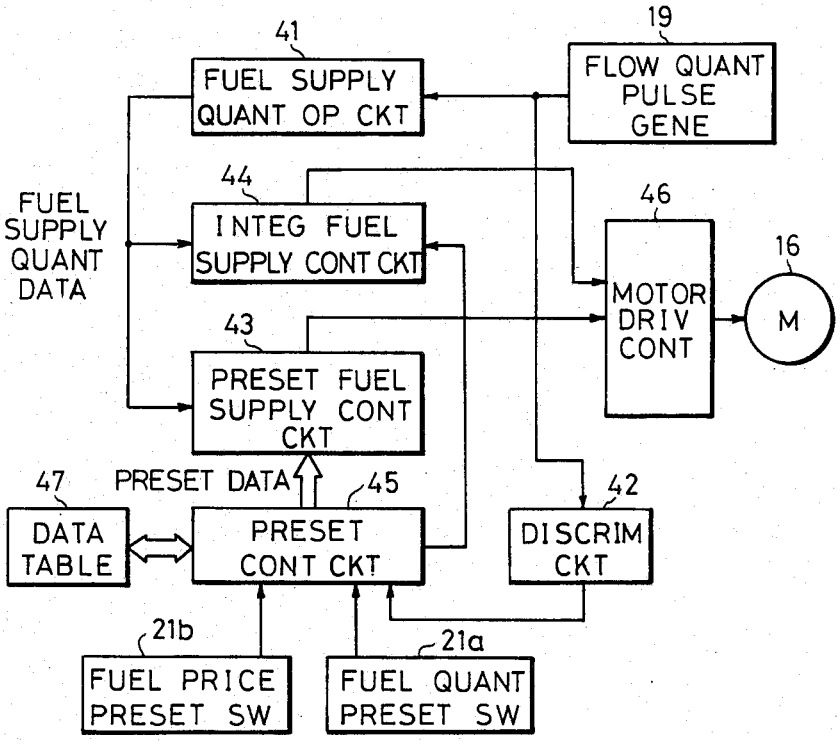
FIG. 10 is a systematic block diagram showing a control device within the control system shown in FIG. 2.

Next, the systematic block diagram showing an embodiment of a circuit within the control apparatus 23 shown in FIG. 2 will not be described in conjunction with FIG. 10.

The flow quantity pulse signal from the flow quantity pulse generator 19 is supplied to a fuel supply quantity operation circuit 41 and to a discrimination circuit 42. The operation circuit 41 calculates data of the supplied fuel on the basis of the flow quantity pulse signal and supplies the data thus calculated to a preset fuel supplying control circuit 43 and to an integral quantity fuel supplying control circuit 44. The discrimination circuit 42 discriminates whether the fuel supplying apparatus is in a fuel supplying state or a non-fuel supplying state before the start of a fuel supply, and supplies an output to a presetting control circuit 45. The presetting control circuit 45 sets the preset value in correspondence with the manipulation of the fuel supplying quantity preset switch 21*a* and the fuel supplying price preset switch 21*b* when it is discriminated in the discrimination circuit 42 that the fuel supplying apparatus is in the state before the start of a fuel supply. The preset value is set by extracting data from a data table 47 which contains data corresponding to the preset values of the preset fuel supplying quantity and the preset fuel supplying price. The preset data is supplied to the preset fuel supplying control circuit 43. On the other hand, when it is discriminated in the discrimination circuit 42 that the fuel supplying apparatus is in the fuel supplying state, the presetting control circuit 45 supplies a fuel supplying mode change signal to the integral quantity fuel supplying control circuit 44. The fuel supplying mode change signal is dependent on the outputs of the preset switches 21*a* and 21*b*. In this way, the preset fuel supplying control circuit 43 and the integral quantity fuel supplying control circuit 44 control pump motor driving means 46 and carries out the above mentioned preset fuel supplying operation and the integral quantity fuel supplying operation.

According to the present invention, it is not only possible to preset the fuel supplying quantity and fuel supplying price by manipulation of the fuel supplying price preset switch 21*a* and the fuel supplying price preset switch 21*b*, respectively, but it is also possible to change the mode of the preset fuel supplying operation from the preset quantity fuel supplying mode to the preset price fuel supplying mode, or vice versa. The fuel supplying apparatus according to the preset invention is extremely advantageous in that it promptly responds to the change in the fuel supplying mode and changes the display to indicate the on-going fuel supplying mode.

Further, the present invention is not limited to these embodiments, but various variations and modifications may be made without departing from the scope of the present invention.

What is claimed is:

1. A fuel supplying apparatus comprising: a fuel supplying hose having a fuel supplying nozzle provided on a tip end thereof;

preset switch means comprising a fuel supplying quantity preset switch and a fuel supplying price preset switch provided on said fuel supplying hose at a position in the vicinity of said fuel supplying nozzle, said fuel supplying quantity preset switch being a switch for selectively and sequentially presetting a predetermined quantity of fuel for preset quantity fuel supplying operation in response to the number of manipulation times of the switch, said fuel supplying price preset switch being a switch for selectively and sequentially presetting a predetermined price of fuel for preset price fuel supplying operation in response to the number of manipulation times of the switch;

indicating means for indicating either one of the predetermined quantity and the predetermined price preset by said preset switch means; and control means for presetting either one of the preset quantity or the preset price selected from a predetermined plural number of prsest quantities and a predetermined plural number of preset prices, in response to the selective manipulation of either one of said fuel supplying quantity preset switch and said fuel supplying price preset switch as well as to the number of manipulation times of the selected switch, said indicating means indicating said preset fuel quantity or said preset fuel price preset in said control means, said control means changing the fuel supplying mode from one of the preset quantity fuel supplying mode and the preset price fuel supplying mode to the other mode, during a fuel supplying operation, whereby said selective manipulation of one of said fuel supplying preset switches places said apparatus in the respective fuel supplying mode and said fuel supplying mode is changed, during said fuel supplying operation, when the other of said fuel supplying preset switch is manipulated.

2. A fuel supplying apparatus as claimed in claim 1 in which said control means discriminates which one of said fuel supplying quantity preset switch and said fuel supplying price preset switch is manipulated, and sequentially presets the fuel quantity or the fuel price in response to the number of manipulation times of said respective preset switch.

3. A fuel supplying apparatus as claimed in claim 1 in which said indicating means comprises a first indicating part in which predetermined plural number of numerals representing the preset quantities are aligned in a row, a second indicating part in which predetermined plural number of numerals representing the preset prices are aligned in a row, the respective numerals of the first indicating part and the respective numerals of the second indicating part being located so as to form a pair with each other, a first indication means located in correspondence with respective numerals of said first and second indicating parts, and a second indication means respectively located in said first and second indicating parts, a control circuit makes the indicating means indicate either of said first or second indicating parts, by means of said second indication means, in response to the manipulated one of the fuel supplying quantity preset switch and said fuel supplying price preset switch, and the numerals which are successively and selectively preset, by said first indication means, in response to said number of manipulation times of the manipulated preset switch.

4. A fuel supplying apparatus as claimed in claim 3 in which said first indication means comprises plural indication lamps which are aligned in a row between the numerals of said first indicating part and the numerals of said second indicating part which are arranged to make pairs with each other, said second indication means comprises two indication lamps which are provided in said first and second indicating parts, said indication lamps of said first indication means sequentially turning on in response to the number of manipulation times of said preset switch and indicating the corresponding numerals of said first and second indication parts, and the indication lamp of said second indicating means being turned on in response to one of the preset switches which is manipulated.

5. A fuel supplying apparatus as claimed in claim 1 which further comprises a structure, an elevator mechanism provided on said structure for raising and lowering said fuel supplying hose and said fuel supplying nozzle which are suspended from said structure, and an elevator switch for driving said elevator mechanism, said preset switch means and said elevator switch being respectively provided on said fuel supplying hose at positions in the vicinity of said fuel supplying nozzle.

* * * * *